US008984701B2

(12) United States Patent
Tussy

(10) Patent No.: US 8,984,701 B2
(45) Date of Patent: Mar. 24, 2015

(54) FLEXIBLE HANDLE FOR CLEANING TOOLS

(76) Inventor: Kevin Alan Tussy, Las Vegas, NV (US)

( * ) Notice: Subject to any disclaimer, the term of this patent is extended or adjusted under 35 U.S.C. 154(b) by 387 days.

(21) Appl. No.: 13/207,252

(22) Filed: Aug. 10, 2011

(65) Prior Publication Data

US 2013/0036564 A1 Feb. 14, 2013

(51) Int. Cl.

| | |
|---|---|
| ***A46B 5/02*** | (2006.01) |
| ***B25G 1/02*** | (2006.01) |
| ***A46B 5/00*** | (2006.01) |
| ***A47L 13/20*** | (2006.01) |

(52) U.S. Cl.

CPC ..... *B25G 1/02* (2013.01); *A46B 5/0058* (2013.01); *A46B 5/0062* (2013.01); *A47L 13/20* (2013.01); *A46B 5/0033* (2013.01); *A46B 2200/302* (2013.01)

USPC ..... 15/144.1; 15/143.1

(58) Field of Classification Search

CPC ..... A47L 13/24; A47L 13/253; B25G 1/02; B25G 1/04; B25G 1/06; A46B 5/002; A46B 5/0033; A46B 5/0045

USPC ..... 15/144.1, 144.2, 144.3, 159.1, 160, 15/143.1; 403/76, 90, 122, 80, 85

See application file for complete search history.

(56) References Cited

U.S. PATENT DOCUMENTS

| | | | | |
|---|---|---|---|---|
| 1,154,369 | A * | 9/1915 | Browning | 15/160 |
| 1,895,229 | A | 1/1933 | Morton | |
| 1,982,910 | A * | 12/1934 | Forbes et al. | 403/100 |
| 3,624,855 | A | 12/1971 | Shaw | |
| 3,720,974 | A | 3/1973 | Rosendall | |
| 4,793,646 | A * | 12/1988 | Michaud, Jr. | 294/210 |
| 4,794,663 | A | 1/1989 | Vosbikian | |
| 5,001,802 | A | 3/1991 | Humphrey | |
| 6,625,838 | B2 * | 9/2003 | Laux et al. | 15/120.2 |
| 6,637,180 | B2 | 10/2003 | Gullotti | |
| 7,496,984 | B2 | 3/2009 | Pang | |
| 2002/0073681 | A1 | 6/2002 | Roser | |
| 2002/0129594 | A1 | 9/2002 | Gullotti | |

* cited by examiner

*Primary Examiner* — Shay Karls
(74) *Attorney, Agent, or Firm* — Weide & Miller, Ltd.

(57) ABSTRACT

A handle for a cleaning tool such as a floor mop comprising at least two handle segments attached to each other by a flexible connector such that the handle has one configuration in which it is rigid and another configuration in which it is flexible. In one exemplary embodiment, a movable rigid sleeve extends over the entire flexible connector and a portion of each handle segment such that it prevents the flexible connector from bending. When the movable rigid sleeve is moved to a position where it does not extend over the flexible connector, the flexible connector can bend relative to the longitudinal axis of the handle, to allow easy access under cabinets or furniture.

20 Claims, 6 Drawing Sheets

FLEXIBLE HANDLE FOR CLEANING TOOLS

BACKGROUND OF THE INVENTION

1. Field of the Invention

The invention relates generally to the field of cleaning tools. In particular, the invention relates to handles for use with floor cleaning tools.

2. Description of Related Art

The prior art includes a wide range of handles for brooms, other floor cleaning tools such as the SWIFFER® cleaning device, as well as powered and unpowered sweepers and vacuum devices. Prior art devices have failed to effectively provide a handle that is rigid for use in cleaning open floor spaces, but can quickly and easily be adjusted to be sufficiently flexible to extend under counters, coffee tables, chairs, or other furniture to clean floor areas beneath such obstacles without bending over. The present invention provides a simple, effective solution that allows the user to easily switch between a rigid handle and a flexible handle as they are cleaning.

SUMMARY OF THE INVENTION

A handle for a cleaning tool comprising at least two handle segments attached to each other by a flexible connector, a movable rigid sleeve that extends over the entire flexible connector and a portion of each handle segment such that it prevents the flexible connector from bending, wherein, the movable rigid sleeve can slide to a position where it does not extend over the flexible connector, allowing the flexible connector to bend relative to the longitudinal axis of the handle. In an exemplary embodiment of the invention, the flexible connector is a coil spring, or may have one or more joints that provide lateral rigidity to it. In an exemplary embodiment, the handle segments comprise a detent mechanism that is biased normal to the longitudinal axis of the handle, or radially outward from the handle segment and extend out from the outer surface of the handle segment.

In an exemplary embodiment, the movable rigid sleeve is held in a position where it extends over the entire flexible connector and a portion of each handle segment by the ends of the detent mechanism. In another exemplary embodiment, the upper end of the movable rigid sleeve is flared outward such that it can be moved axially over the ends of the detent mechanism, and the ends of the detent mechanism exert a force on the inside surface of the movable rigid sleeve sufficient to hold it in position while the handle is used.

In an exemplary embodiment of the invention, a handle for a cleaning tool comprises at least two handle segments attached to each other by a flexible connector, and a movable rigid rod extending through the flexible connector and into a portion of each handle segment such that it prevents the flexible connector from bending, wherein, the movable rigid rod can slide to a position where it does not extend completely through the flexible connector, allowing the flexible connector to bend relative to the longitudinal axis of the handle.

DETAILED DESCRIPTION OF THE PREFERRED EMBODIMENTS

Figure 1:
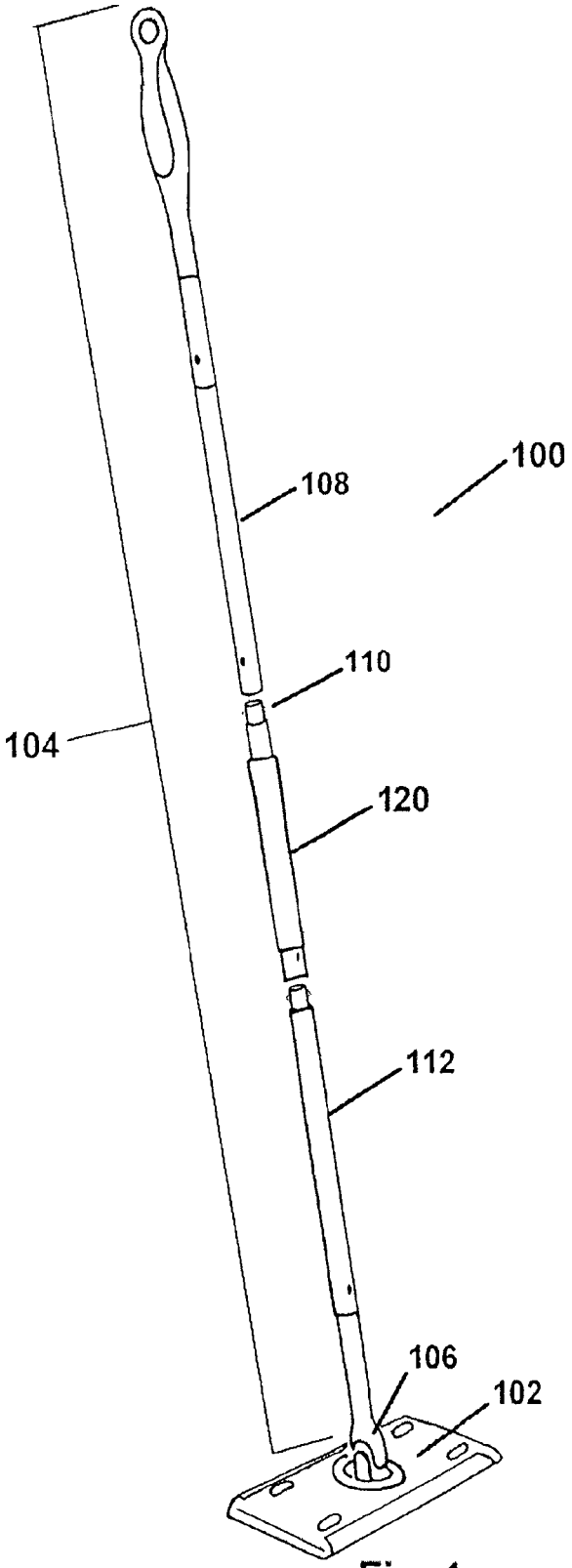
FIG. 1 is a diagram showing an exemplary embodiment of a flexible handle for a cleaning tool with three segments not connected.
Figure 2:
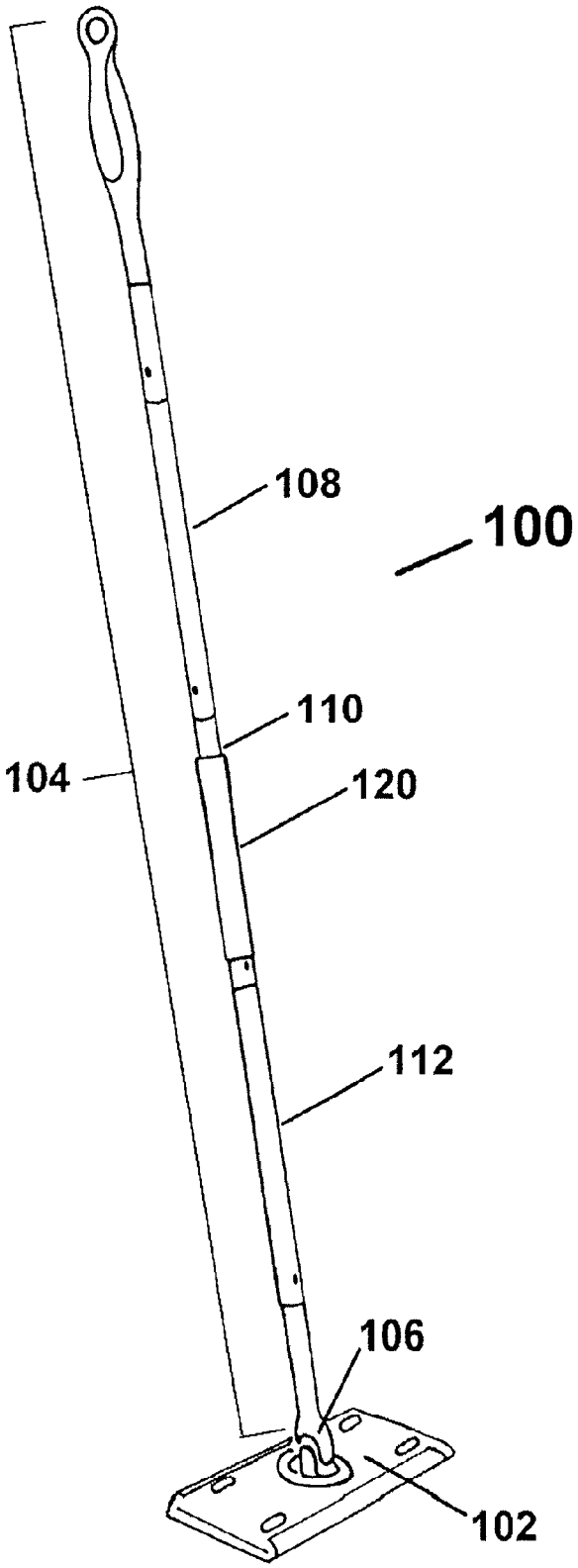
FIG. 2 is a diagram showing an exemplary embodiment of a flexible handle for a cleaning tool with three segments connected.
Figures 3A, 3B, 3C:
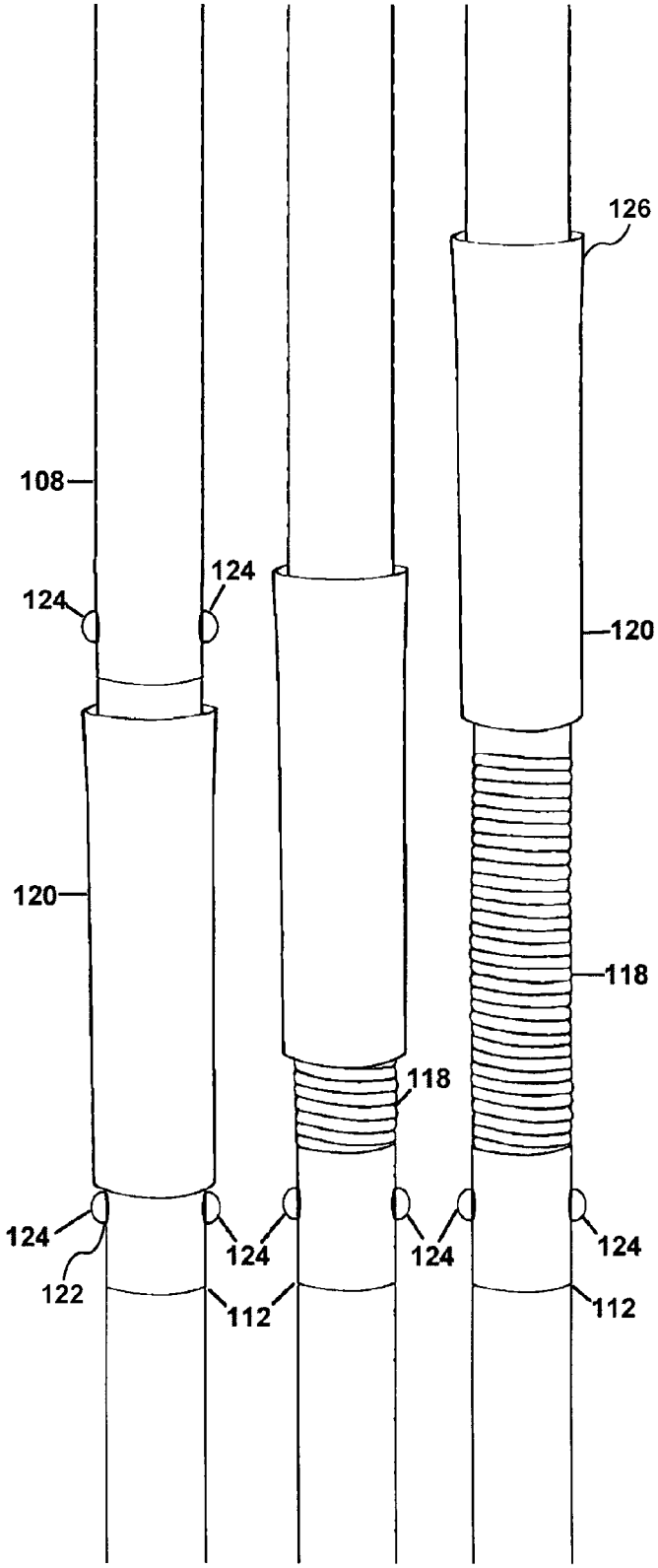
FIG. 3A is a diagram showing a detailed view of a flexible handle segment with the rigid tubular sleeve completely covering the flexible connector.
FIG. 3B is a diagram showing a detailed view of a flexible handle segment with the rigid tubular sleeve partially covering the flexible connector.
FIG. 3C is a diagram showing a detailed view of a flexible handle segment with the rigid tubular sleeve pulled up to completely expose the flexible connector.

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein. Moreover, while the present invention is discussed herein primarily with respect to a floor mop, it will be understood that the present invention can be used with other types of cleaning tools, including tools for cleaning walls and ceilings.

In the present disclosure, various devices are described and set forth with regard to several embodiments. It is contemplated that features of the disclosed embodiments may be combined in any manner as may be desired for various applications and implementations.

Referring to FIGS. 1 through 5, an exemplary embodiment of the invention consists of a floor mop 100 comprising a mop head 102 and a handle 104 that may be pivotally connected to the mop head 102 by a universal joint 106. The mop head 102 shown herein is purely exemplary and it will be understood that the present invention can be used with any type of mop head or other cleaning implement attached to handle 104. The mop head 102 may be configured to clean any type or kind of surface and it may be attached to the handle 104 by any type of suitable joint or connection.

In an exemplary embodiment, the handle 104 may comprise a hollow metal tube, and may be divided into a plurality of handle segments that are connected together. In an exemplary embodiment the handle 104 is divided into an upper segment 108, a middle segment 110, and a lower segment 112 that attaches to the mop head 102. These handle segments may be connected together to form the handle 104 by any suitable means commonly used to connect hollow tubular structures. One common method for connecting the handle segments is to taper one end of a segment so that it can be received into the corresponding end of the connecting segment. The handle segments can be held together by a variety of different mechanisms including threads, friction, or a mechanical device such as a spring-biased detent.

In an exemplary embodiment, one or more of the handle segments is further divided into two segment ends 114 and 116 which are held together by a flexible connector 118 such as coil spring that is secured within each of the two segment ends. The divided handle segment has a rigid tubular sleeve 120 that can slide over the outside of the divided handle segment along the longitudinal axis of the handle 104, and which is long enough to completely cover the space between the two segment ends where the flexible connector is exposed and extend some distance further over the two segment ends.

Figure 4:
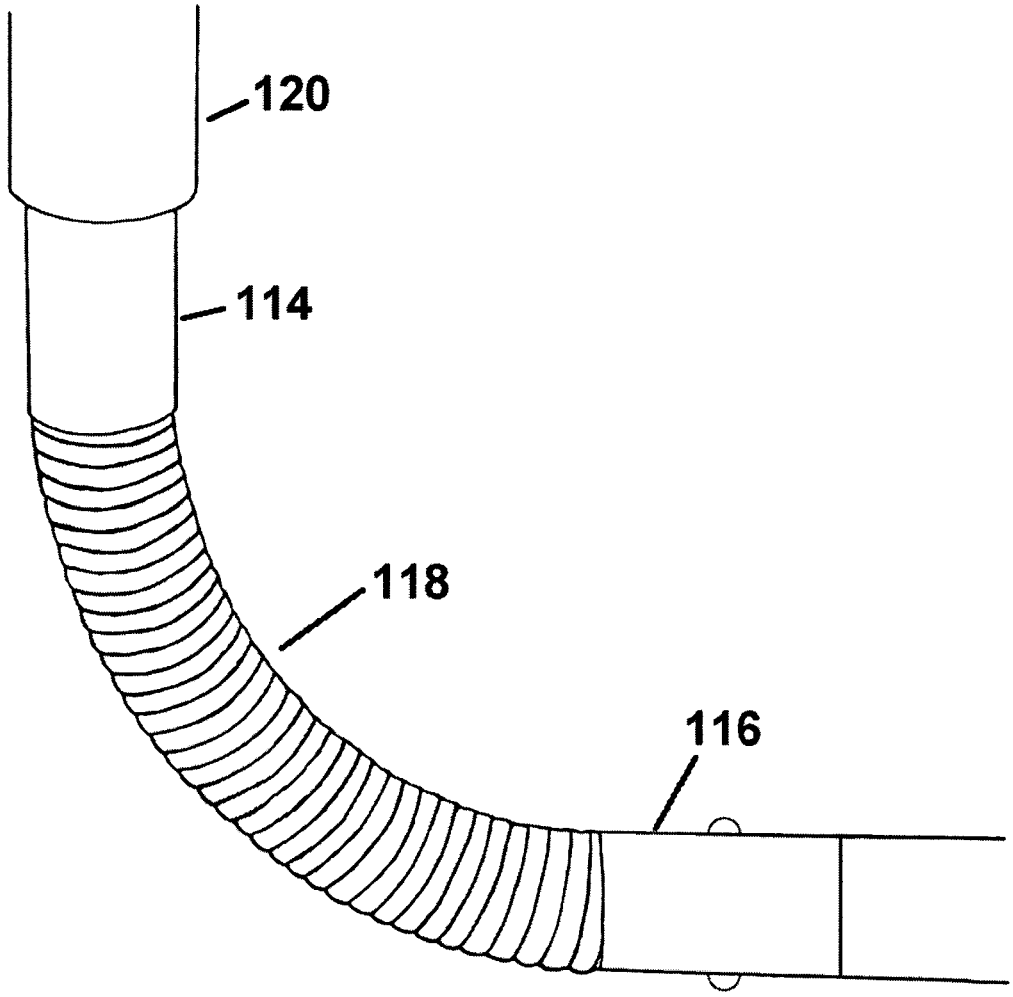
FIG. 4 is a diagram showing a detailed view of a flexible handle segment with the rigid tubular sleeve pulled up to completely expose the flexible connector and the flexible connector in the flexed position.
Figure 5:
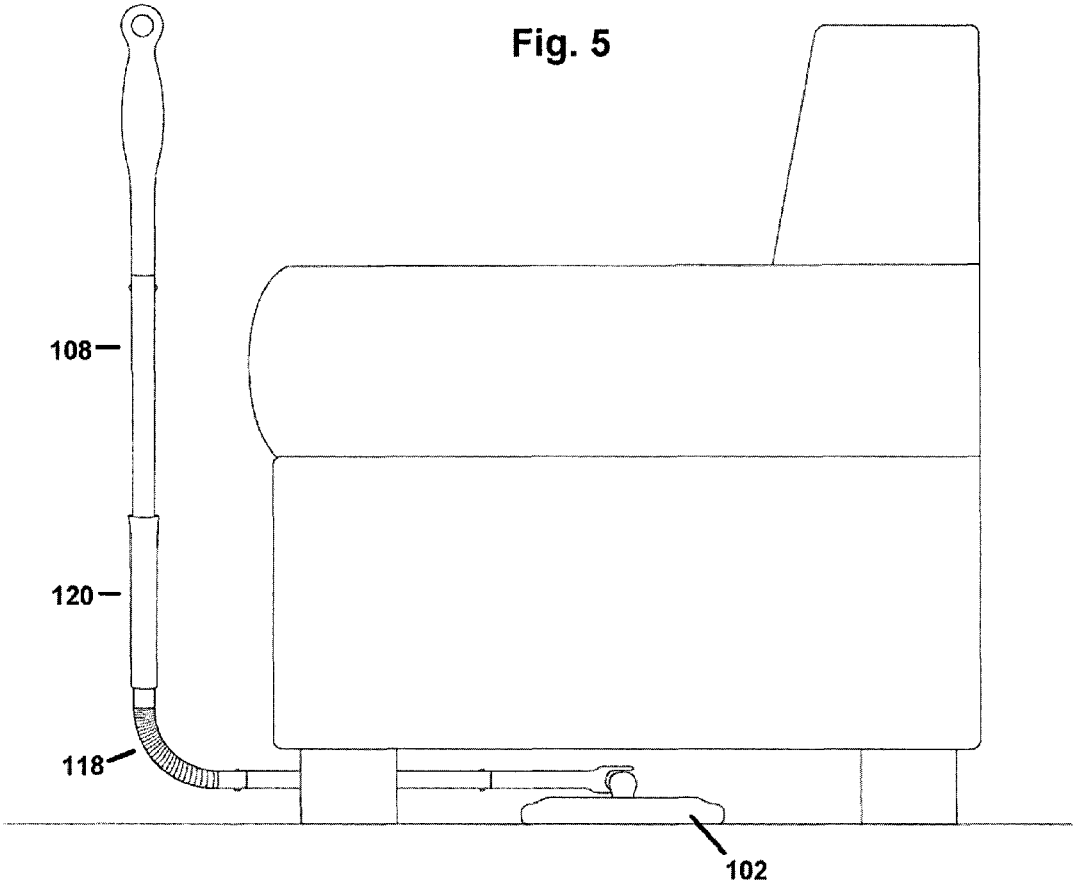
FIG. 5 is a diagram showing an exemplary embodiment of a flexible handle for a cleaning tool in the flexed position during use.

When positioned so that it completely covers the flexible connector 118, the rigid tubular sleeve 120 prevents the flexible connector 118 from bending, such that the divided handle segment is axially rigid across its entire length. However, as illustrated in FIG. 4, if the rigid tubular sleeve 120 is moved so that it no longer covers the flexible connector 118, the divided handle segment is free to bend in accordance with the flex characteristics of the flexible connector 118. When such a divided handle segment is incorporated into a handle 104, it provides a point on the handle 104 where the user can selectively provide for flexibility during use.

In one exemplary embodiment, a handle has a divided middle segment 110 with its two segment ends 114 and 116 connected by a flexible connecter 118 in the form of a coil spring. The divided middle segment 110 is rigidly attached to the adjacent upper segment 108 and lower segment 112 by inserting a tapered end of one segment into the end of the adjacent segment until a spring biased detent snaps into corresponding holes 122 in the tubular walls of the outer segment. When in the fixed position, the ends 124 of the spring biased detent extend out through the holes 122. To separate the two segments, the user simply presses inward on the ends 124 of the spring biased detent and pulls the two segments apart.

Rigid tubular sleeve 120 has an inner diameter slightly larger than the outer diameter of the handle segments 108, 110, and 112, such that it can slide axially along the handle 104. In an exemplary embodiment, its inside diameter is small enough that the sleeve cannot pass over the ends 124 of the spring biased detent unless they are partially depressed. Thus, the ends 124 of the spring biased detent located at the connection between the divided middle segment 110 and the lower segment 112 prevent the rigid tubular sleeve 120 from sliding downward and can be positioned to hold the rigid tubular sleeve 120 in position such that it completely covers the flexible connector 118 and extends far enough over the two segment ends 114 and 116 to keep the divided segment rigid.

If the user wants to switch to a flexible handle, they simply slide the rigid tubular sleeve 120 axially upward until the flexible connector 118 is completely exposed. This allows the handle to bend at the location of the flexible connector 118 in accordance with the flex characteristics of the flexible connector 118. In an exemplary embodiment, the upper end 126 of the rigid tubular sleeve 120 can be flared slightly outward such that as the rigid tubular sleeve 120 is drawn upward the flared portion of the upper end 126 will depress the ends 124 of the spring biased detent at the connection between the divided middle segment 110 and the upper segment 108 and allow the sleeve to be drawn up onto the upper segment 108 until the flexible segment is fully exposed.

If the rigid tubular sleeve 120 is not pulled up past the ends 124 of the spring biased detent, the outward pressure of the ends 124 on the inner wall of the rigid tubular sleeve 120 may hold it in position. When the user wants to return the handle to a rigid configuration, they simply slide the sleeve back down so it again rests on the ends 124 of the spring biased detent at the connection with the lower segment 112. In an exemplary embodiment, the rigid tubular sleeve 120 is provided with an annular flange or other stop on its inside wall near the lower end to prevent it from being easily pulled up so that passes fully over the ends 124 of the spring biased detent.

If the rigid tubular sleeve 120 does passes fully over the ends 124 of the spring biased detent, the ends 124 will extend back to their fully extended position and prevent the rigid tubular sleeve 120 from sliding downward back over the flexible connector 118. When the user wants to return the handle to a rigid configuration, they simply partially depress the ends 124 of the spring biased detent to allow the rigid tubular sleeve 120 to slide back down over the flexible connector 118 where it is held in place by the detent holding the middle segment 110 and the lower segment 112 together.

It will be readily understood that a wide variety of mechanisms can be used to hold the rigid tubular sleeve 120 in various positions, including clips, friction mechanisms such as an internal friction ring, detents, latches, etc. Moreover, while the discussion herein relates to embodiments in which the rigid tubular sleeve 120 is moved manually by direct manipulation, it will be readily understood that it could be moved by a wide variety of mechanical devices such that the user might pull a trigger or squeeze or rotate a mechanism to move the rigid tubular sleeve axially along the handle 104.

Figure 6A:
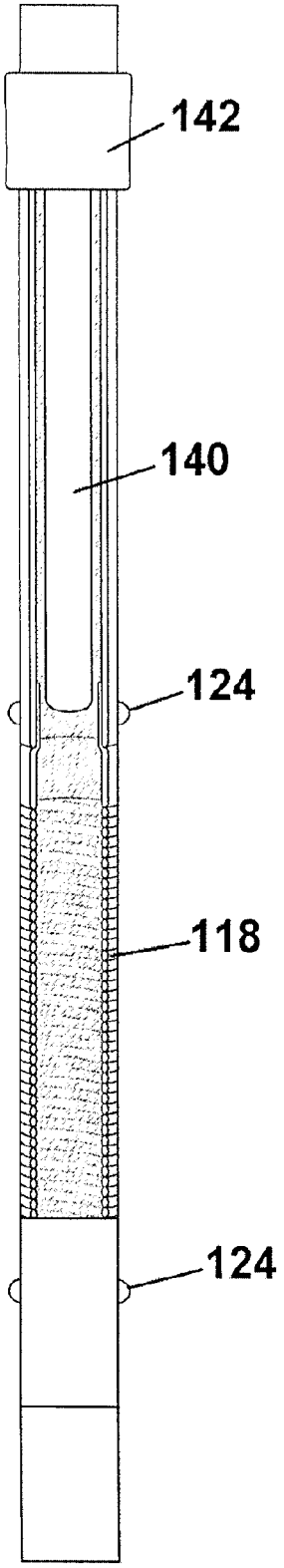
FIG. 6A is a partial cutaway diagram showing an exemplary embodiment of a flexible handle segment in the flexible position.
Figure 6B:
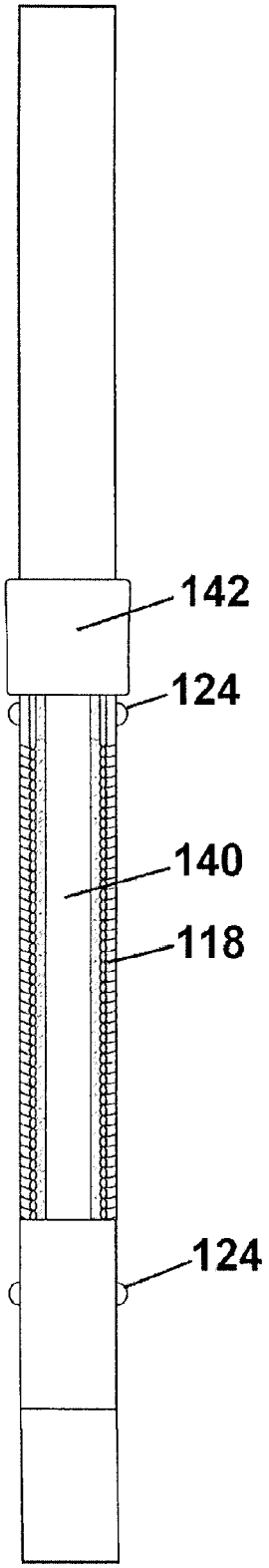
FIG. 6B is a partial cutaway diagram showing an exemplary embodiment of a flexible handle segment in the rigid position.

While extensive reference is made herein to the use of a rigid tubular sleeve 120, it will be readily understood that a wide variety of specific mechanisms can be used to provide rigidity to the handle segment comprising the flexible connector 118. For example, referring to FIGS. 6A and 6B, in an exemplary embodiment a movable rigid rod 140 may be is positioned within the handle segments such that it can be moved by the user to provide rigidity to the flexible segment. Such a mechanism requires an external ring 142 or other mechanism that can be manipulated by the user to move the rigid rod 140 into various positions.

In an exemplary embodiment, one or more joints or other structures can be included in the flexible connector 118 to provide strength, stability, or influence the flex characteristics. For example, one or more joints can be included that provide greater lateral stability to the flexible connector 118 to prevent side-to-side movement.

It will be readily understood that while the descriptions herein relate primarily to a handle 104 that is divided into an upper segment 108, a middle segment 110, and a lower segment 112 that attaches to the mop head 102, the invention can be used with handles that have only two segments, one above the flexible connector and one below it, or with a plurality of segments and even with multiple flexible connectors to provide additional degrees of freedom of movement. In addition, the characteristics of the flexible connector(s) can be widely varied to provide for different degrees of flexibility through various ranges of angles and directions.

What is claimed is:

1. A handle for a cleaning tool comprising:

at least two handle segments and a flexible connector, the at least two handle segments including an upper handle segment and a lower handle segment, the upper handle segment including at least one raised surface, the flexible connector connecting the upper handle segment to the lower handle segment, and the flexible connector being configured with one or more joints that provide lateral rigidity; and a movable rigid sleeve configured to extend over the entire flexible connector and a portion of each handle segment such that it prevents the flexible connector from bending, the sleeve including a top flared end and a bottom end;

the movable rigid sleeve being configured to slide into an upward position in which (i) the movable rigid sleeve is in frictional contact with the at least one raised surface, the frictional contact maintaining the position of the sleeve in the upward position, and (ii) the sleeve does not extend over the flexible connector, allowing the flexible connector to bend relative to a longitudinal axis of the handle.

2. The device of claim 1, wherein the flexible connector is a coil spring.

3. The device of claim 1, wherein the raised surface is a detent mechanism that is biased normal to the longitudinal axis of the handle.

4. The device of claim 3, wherein the detent mechanism includes ends that are biased radially outward from the handle segment and extend out from the outer surface of the handle segment.

5. The device of claim 4, wherein the movable rigid sleeve is held in a position where it extends over the entire flexible connector and a portion of each handle segment by the ends of the detent mechanism.

6. The device of claim 4, wherein the top flared end of the movable rigid sleeve is flared outward such that it can be moved axially over the ends of the detent mechanism.

7. The device of claim 6, wherein the ends of the detent mechanism exert a force on the inside surface of the movable rigid sleeve sufficient to hold it in position while the handle is used.

8. The device of claim 1, wherein the top flared end of the sleeve creates a space between the upper handle segment and the top flared end of the sleeve that is greater than a height of the at least one raised surface.

9. The device of claim 1, further comprising one or more additional handle segments that may attach to either or both of the upper handle segment or the lower handle segment to thereby change the position of the flexible connector relative to the cleaning tool.

10. The device of claim 1, wherein the sleeve has an outer surface, defined by the outer surface between the top flared end and the bottom end, that does not contain any holes or slots.

11. The handle according to claim 1, wherein the flexible connector comprises a first rigid end, a second rigid end, and a flexible member that connects the first rigid end to the second rigid end.

12. The handle according to claim 11, wherein the first rigid end comprises one of the at least one raised surface or holes configured to receive the at least one raised surface.

13. A handle for a cleaning tool comprising:

at least two handle segments and a flexible connector, the flexible connector connecting a first handle segment of the at least two handle segments to a second handle segment of the at least two handle segments, and the flexible connector comprising one or more joints that provide lateral rigidity; and a movable rigid rod having a diameter that is greater than one-half of the diameter of an inner area of the flexible connector, the rod being configured to extend through the flexible connector and into a portion of each handle segment such that it prevents the flexible connector from bending, and being configured to slide to a position where it does not extend completely through the flexible connector, allowing the flexible connector to bend relative to a longitudinal axis of the handle.

14. The device of claim 13, wherein the flexible connector is a coil spring.

15. The device of claim 13, wherein the handle segments comprise a detent mechanism that is biased normal to the longitudinal axis of the handle.

16. The device of claim 15, wherein the detent mechanism includes ends that are biased radially outward from the handle segment and extend out from the outer surface of the handle segment.

17. The handle of claim 13, further comprising an external ring that at least partially surrounds at least one of the at least two handle segments, the external ring configured such that movement of the external ring moves the rod.

18. A handle for a cleaning tool comprising:

a first handle segment having a first end and a second end;

a second handle segment having a first end and a second end, the second end of the second handle configured to connect to the cleaning tool;

a flexible connector having a first end and a second end;

at least one upper spring biased detent configured to connect the second end of the first handle to the first end of the flexible connector;

at least one lower spring biased detent configured to connect the first end of the second handle to the second end of the flexible connector; and a sleeve having a flared first sleeve end and a second sleeve end, the at least one lower spring biased detent and the second sleeve end configured to stop the sleeve from moving below the at least one lower spring biased detent toward the cleaning tool, such that the sleeve is configured to be in:

a lower position that covers the flexible connector to inhibit bending of the flexible connector, and an upper position that places the sleeve in frictional engagement with the at least one upper spring biased detent to hold the sleeve in the upper position thereby allowing bending of the flexible connector.

19. The handle according to claim 18, wherein the first end of the flexible connector is a first rigid member, the second end of the flexible connector is a second rigid member, and a coil spring connects the first rigid member to the second rigid member.

20. The handle according to claim 19, wherein the first rigid member comprises one of the upper spring biased detent or holes to receive the upper spring biased detent, and the second end of the first handle comprises the other of the upper spring biased detent or holes to receive the upper spring biased detent.

* * * * *